United States Patent [19]

Budzich

[11] 4,159,724

[45] Jul. 3, 1979

[54] LOAD RESPONSIVE CONTROL VALVE

[76] Inventor: Tadeusz Budzich, 80 Murwood Dr., Moreland Hills, Ohio 44022

[21] Appl. No.: 895,041

[22] Filed: Apr. 10, 1978

Related U.S. Application Data

[63] Continuation-in-part of Ser. No. 635,294, Nov. 26, 1975.

[51] Int. Cl.[2] ..... F15B 13/08

[52] U.S. Cl. ..... 137/596.13; 91/451

[58] Field of Search ..... 60/427; 91/451; 137/596.13

[56] References Cited

U.S. PATENT DOCUMENTS

| | | | |
|---|---|---|---|
| 3,416,561 | 12/1968 | Kokaly | 137/596.13 X |
| 3,444,689 | 5/1969 | Budzich | 60/427 UX |
| 3,470,694 | 10/1969 | Budzich | 60/427 |
| 3,882,896 | 5/1975 | Budzich | 91/451 X |
| 3,977,301 | 8/1976 | Kroth et al. | 137/596.13 X |
| 3,989,062 | 11/1976 | Tennis | 137/596.13 |

*Primary Examiner*—Gerald A. Michalsky

[57] ABSTRACT

A pressure compensated load responsive flow control valve for use in a system controlling a plurality of loads. The system is powered by a single, fixed displacement pump. The flow control valve is equipped with a load responsive control, which during simultaneous control of multiple loads automatically maintains the pump discharge pressure at a level higher by a constant pressure differential than the pressure required by the largest load being controlled and which while system loads are not being controlled automatically reduces the pump bypass pressure to a minimum level lower than the constant pressure differential of the load responsive control.

20 Claims, 2 Drawing Figures

LOAD RESPONSIVE CONTROL VALVE

This a continuation in part of application Ser. No. 635,294, filed Nov. 26, 1975 for "Load Responsive Control Valve".

BACKGROUND OF THE INVENTION

This invention relates generally to load responsive bypass flow control of a fixed displacement pump, which automatically maintains pump discharge pressure higher, by a constant pressure differential, then the load pressure signal transmitted from system control valves.

In more particular aspects this invention relates to bypass flow control of a fixed displacement pump, which is controlled by a pilot valve responsive to load pressure signals transmitted from system control valves.

In still more particular aspects this invention relates to an unloading control of load responsive bypass flow control of a fixed displacement pump, which in absence of load pressure signal permits the load responsive bypass flow control by bypass pump flow to system reservoir at a minimum pressure level, lower than the constant pressure differential of load responsive bypass flow control.

During control of positive load the load responsive bypass flow control of a fixed displacement pump automatically maintains a constant pressure differential between the pump discharge pressure and the load pressure. Depending on the type of control and on the required response characteristics this constant pressure differential may be quite high. Since during standby condition the load responsive bypass flow control will maintain the system pressure at a level equal to the constant pressure differential of the control, the standby horsepower loss can be quite high.

SUMMARY OF THE INVENTION

It is therefore a principle object of this invention to provide a load responsive bypass flow control of a fixed displacement pump, which maintains a constant pressure differential between pump discharge and load pressure with a load responsive unloading control.

It is another object of this invention to provide a load responsive unloading control, which will lower the system standby pressure, while system is not controlling a load to a level below that of constant pressure differential of load responsive bypass flow control, reducing the standby horsepower loss of the system.

Briefly the foregoing and other additional objects and advantages of this invention are accomplished by providing a novel load responsive unloading valve in combination with a two stage load responsive pilot operated differential bypass valve. With the system in standby condition the load responsive unloading valve lowers the system standby pressure to a level below that of constant pressure differential of the bypass valve, reducing horsepower loss in the standby condition of the system.

Additional objects of the invention will become apparent when referring to the preferred embodiments as shown in the accompanying drawings and described in the following detailed description.

DESCRIPTION OF THE PREFERRED EMBODIMENTS

Figure 1:
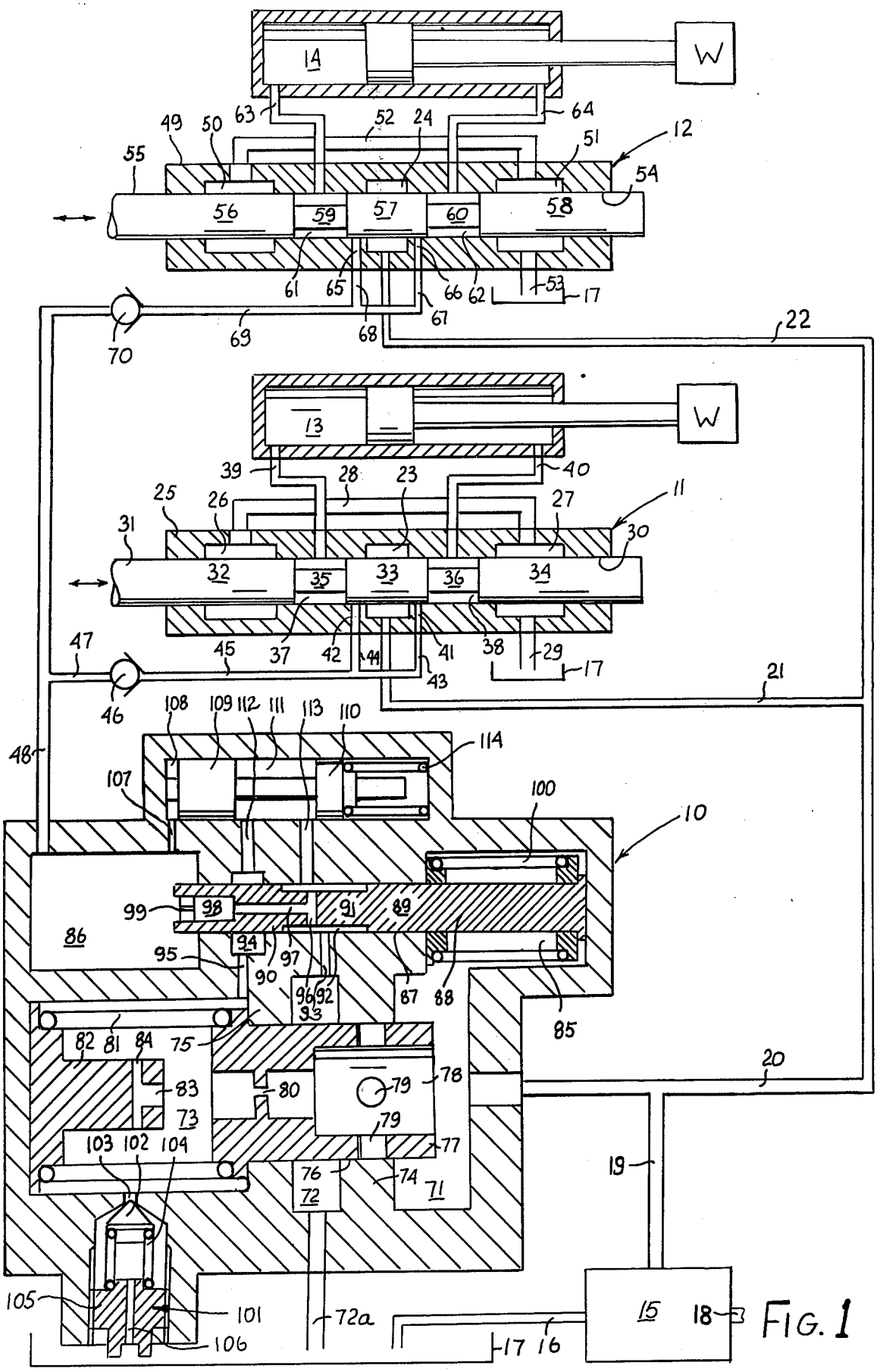
FIG. 1 is a longitudinal sectional view of an embodiment of two stage pilot operated differential bypass valve equipped with load responsive unloading valve used in control of flow from schematically shown direction control valves with system lines, pump and reservoir shown diagramatically.

Referring now to the drawings, FIG. 1 shows a section through a differential bypass valve assembly, generally designated as 10, connected into a circuit with direction control valve assemblies, generally designated as 11 and 12, controlling actuators 13 and 14 which drive loads W. Although in FIG. 1 for purposes of demonstration of the principle of the invention, differential bypass valve assembly 10 and direction control valve assemblies 11 and 12 are shown separated, in actual application they would be most likely contained in a single valve housing or would be bolted together as sections of a sectional valve assembly. As shown, fixed displacement pump 15 has an inlet line 16 which supplies fluid to pump from a reservoir 17 and the pump is driven through a shaft 18 by a prime mover not shown. The pump has an outlet line 19 which connects through line 20 to differential bypass valve assembly 10 and through lines 21 and 22 with inlet chambers 23 and 24 of direction control valve assemblies 11 and 12 respectively.

Direction control valve 11 has a valve housing 25 which defines inlet chamber 23 and also defines outlet chambers 26 and 27, which are connected to each other by a duct 28 and are further connected by a line 29 to reservoir 17. Valve housing 25 axially guides in a valve bore 30 a valve spool 31 which by lands 32, 33 and 34 and stems 35 and 36 defines load chambers 37 and 38, which are connected through lines 39 and 40 to actuator 13. Load sensing ports 41 and 42 are connected through lines 43, 44 and 45 to a check valve 46 which in turn is connected by lines 47 and 48 to differential bypass valve assembly 10.

Similarly direction control valve assembly 12 has a valve housing 49 which defines inlet chamber 24 and also defines outlet chambers 50 and 51, which are connected to each other by a duct 52 and further connected by a line 53 to reservoir 17. Valve housing 49 axially guides in a valve bore 54 a valve spool 55 which by lands 56, 57 and 58 and stems 59 and 60 defines load chambers 61 and 62, which are connected through lines 63 and 64 to actuator 14. Load pressure sensing ports 65 and 66 are connected through lines 67, 68 and 69 to a check valve 70, which in turn is connected by line 48 to differential bypass valve assembly 10.

The differential bypass valve assembly 10 has a supply chamber 71 communicating with pump 15, an exhaust chamber 72 communicating through a line **72*a* with reservoir 17 and a control chamber 73, those chambers being separated by partitions 74 and 75. A bore 76 passing through partitions 75 and 74 interconnects supply chamber 71, exhaust chamber 72 and control chamber 73 and axially guides a bypass member 77. Bypass member 77 has an inner bore 78 provided with extending circumferentially spaced ports 79 blocked, as shown in position in FIG. 1, by partition 74. Inner bore 78 communicates through a leakage orifice 80** in bypass member 77 with control chamber 73. A control spring 81, interposed between bypass member 77 and a stop 82, biases bypass member 77 towards a position, as shown in FIG. 1. Stop 82 is provided with passages 83 and 84.

A portion of space 85 of supply chamber 71 is interconnected with a load pressure chamber 86 by a bore 87 axially guiding a differential pressure pilot valve 80. Differential pressure pilot valve 88 has lands 89 and 90 connected by a stem 91 defining an exhaust space 92 connected by a drilling 93 to exhaust chamber 72. A control space 94 in communication with bore 87 is connected by a drilling 95 with control chamber 73. Exhaust space 92 is connected through drillings 96, 97 and 98 and a leakage orifice 99, in differential pressure pilot valve 88, with load pressure chamber 86. A differential spring 100 in space 85 biases differential pressure pilot valve towards position as shown in FIG. 1.

Control chamber 73 is operationally connected by a high pressure pilot relief valve, generally designated as 101, with reservoir 17. High pressure pilot relief valve 101 has a poppet 102 biased into sealing engagement with a passage 103 by a relief valve spring 104, the preload of which is adjusted by a threaded insert 105, equipped with an exhaust flow passage 106.

The load pressure chamber 86 is connected through passage 107 with annular space 108, in direct communication with land 109 of an unloading spool 110. Annular space 111 is connected through passage 112, control space 94 and drilling 95 with control chamber 73, annular space 111 being also connected by passage 113, exhaust space 92, exhaust chamber 72 and line 72*a* with system reservoir 17. The unloading spool 110 is subjected to biasing force of spring 114, which with system at rest maintains it in the position as shown in FIG. 1.

All of the basic system components, as shown in FIG. 1, are at rest in unloaded or unactuated position, with fixed displacement pump 15 not working. With fixed displacement pump 15 started up, the pressure in outlet line 19, line 20 and supply chamber 71 will start to rise. Fluid under pressure from supply chamber 71 will be transmitted through inner bore 78 and leakage orifice 80 to control space 73. The control chamber 73 is connected by passage 112, annular space 111 and passage 113 with system reservoir 17. Therefore bypass member 77 is subjected to a pressure differential, equal to the pressure generated by fixed displacement pump 15 in the supply chamber 71. This pressure, acting on the cross-sectional area of bypass member 77, will move it against the biasing force of control spring 81 from right to left, connecting with ports 79 the supply chamber 71 with the exhaust chamber 72. The equilibrium condition will be reached, at which full discharge flow of the pump is bypassed by bypass member 77 to the system reservoir 17 at a minimum pressure level, corresponding to the preload in the control spring 81, which is so selected that the full bypass flow is obtained at a relatively low pressure, resulting in minimum system standby horsepower loss.

Assume that pressure in the load pressure chamber 86 was sufficiently increased to move the unloading spool 110 from left to right against the bias of the spring 114, blocking with land 109 passage 112 and therefore isolating the control chamber 73 from system reservoir 17. Fluid flow, transmitted through leakage orifice 80, will increase pressure in the control chamber 73 and the bypass member 77 will be moved by control spring 81 from left to right, increasing the resistance by bypass flow between the supply chamber 71 and the exhaust chamber 72. The increasing fluid pressure in supply chamber 71, transmitted to space 85, will react on the cross-sectional area of differential pressure pilot valve 88, generating a force, which tends to move it from right to left, against the biasing force of differential spring 100. The load pressure chamber 86, is adjusted to low pressure and is connected through leakage orifice 99, drillings 98, 97, 96, space 92, drilling 93, exhaust chamber 72 and line 72*a* with the system reservoir 17.

As soon as pressure in supply chamber 71 and space 85 generates a sufficiently high force on cross-sectional area of differential pressure pilot valve 88 to overcome the preload of differential spring 100 and low pressure in a load pressure chamber 86, differential pilot valve 88 will move from right to left, trying to displace fluid from load pressure chamber 86. The resulting rise in pressure in load pressure chamber 86 will first close check valves 46 and 70, isolating load pressure chamber 86 from direction control valve assemblies 11 and 12. Rising pressure in load pressure chamber 86 will induce, in a well known manner, fluid flow through leakage orifice 99, permitting movement of of differential pressure pilot valve 88 from right to left, the speed of the movement initially being proportional to rate of leakage through leakage orifice 99 and therefore being a function of pressure in load pressure chamber 86 and cross-sectional area of differential pilot valve 88. The movement of differential pressure pilot valve 88, through the displacement of land 90, will connect exhaust space 92 with control space 94, permitting a flow of fluid from pressurized control chamber 73 to reservoir 17 through drilling 95, control space 94, exhaust space 92, drilling 93, exhaust chamber 72 and drilling 72*a*. The pressurized fluid, lost in this way from control chamber 73, must be replenished from supply chamber 71, through leakage orifice 80. In a well known manner, pressure drop through leakage orifice 80 caused by the resulting fluid flow will maintain control chamber 73 at a lower pressure level than supply chamber 71, subjecting bypass member 77 to a force, tending to move it from right to left, against biasing force of control spring 81. Once the pressure drop through leakage orifice 80 creates a sufficiently large pressure differential between control chamber 73 and supply chamber 71 and generates a sufficiently large force, acting on bypass member 77, bypass member 77, will move from right to left, against biasing force of control spring 81. This movement will gradually increase the passage between ports 79 of bypass member 77 and exhaust chamber 72, connecting chamber 71 with reservoir 17. Under those conditions the fluid supplied by pump 15 to supply chamber 71 will be bypassed to exhaust chamber 72 and a condition of equilibrium will be established, under which sufficiently high pressure is maintained in supply chamber 71 to keep differential pressure pilot valve 88 displaced against biasing force of differential spring 100, and to induce sufficient flow from control space 73 to generate a sufficiently high pressure drop through leakage orifice 80, to provide sufficient force to maintain bypass member 77 in its bypass position. Therefore, with passage 112 closed by land 109 of unloading spool 110 under full bypass condition, pressure in the supply chamber 71 will be equal to the biasing force of differential spring 100 divided by the cross-sectional area of differential pressure pilot valve 88. The cross-sectional area of differential pressure pilot valve 88 is small and its movement from its neutral position to connect exhaust space 92 and control space 94 is also small, so that only a minimal displacement of fluid from the load pressure chamber 86 is required to bring differential pressure pilot valve 88 into its modulating position, resulting in a very fast response, even at very small leakage levels through leakage orifice 99. The biasing force of the differential spring 100 is so selected that proper operation of direction control valve assemblies 11 and 12 is assured.

Assume that during the equilibrium bypass condition of differential bypass valve assembly 10, the valve spool 31 is initially displaced from left to right, displacement of land 33 connecting load chamber 37 with load sensing port 42. Assume also that load chamber 37 is subjected to pressure of positive load W, transmitted from actuator 13 through line 39. Load pressure from load sensing port 42, transmitted through lines 44 and 45, will open check valve 46 and pressurize load pressure chamber 86, while maintaining the check valve 70 closed. The rising pressure in load pressure chamber 86 will maintain the unloading spool 110 in a position in which passage 112 is closed and will disrupt the equilibrium of forces, acting on differential pressure pilot valve 88, moving it from left to right and closing the passage between control space 94 and exhaust space 92. As a result, the pressure drop through leakage orifice 80 will be reduced, the only flow through leakage orifice 80 being that caused by resulting displacement from left to right of the bypass member 77, under action of biasing force of spring 81, which will gradually reduce the effective area of ports 79 and proportionally increase the pressure in supply chamber 71. The rising pressure in supply chamber 71 and space 85 will counteract the effect of rising pressure in load pressure chamber 86, until a point is reached, at which movement of the differential pressure pilot valve 88 from right to left will reestablish communication between control space 94 and exhaust space 92. This in turn, as previously described, will induce flow from control space 73, which in turn will position bypass member 77 in a new position, equivalent to the new condition of equilibrium, under which pressure in the supply chamber 71 will be maintained at a level, higher by a constant pressure differential, equal to the biasing force of the differential spring 100 divided by the cross-sectional area of the differential pressure pilot valve 88, than the load pressure signal transmitted from the load W and actuator 13 to load pressure chamber 86. Under these conditions differential pressure pilot valve 88 will regulate the flow from control chamber 73 and resulting pressure differential between control chamber 73 and supply chamber 71, to regulate the position of the bypass member 77, to maintain the pressure in supply chamber 71 at a level, higher by a constant pressure differential, than the load pressure signal transmitted to the load pressure chamber 86.

Assume that valve spool 31 is further displaced from left to right connecting load chamber 37 and load sensing port 42 with inlet chamber 23 while at the same time connecting load chamber 38 with outlet chamber 27. As previously described inlet chamber 23 is maintained by pump 15 at a pressure, higher by a constant pressure differential, than pressure in load chamber 37. Fluid flow will take place from inlet chamber 23 to load chamber 37, this flow being proportional to the area of opening between those two chambers, since a constant pressure differential is maintained between them. Flow into actuator 13, of fluid supplied by the pump 15, will momentarily lower the pump discharge pressure and disturb the equilibrium of differential pressure valve assembly 10. As a result new bypass position of the bypass member 77 will be established and the differential pressure valve assembly 10 will revert to the condition of equilibrium, at which sufficient quantity of fluid from the pump 15 is bypassed to reservoir 17 by the bypass member 77, to maintain, in a manner as previously described, constant pressure differential between load chamber 37 and supply chamber 71. Any sudden rise in load W and corresponding increase in pressure in load chamber 37 and thereforce load pressure chamber 86 will automatically reposition, in a manner as previously described, bypass member 77, to increase the pressure in supply chamber 71 and inlet chamber 23, to establish an equilibrium condition, at which a constant pressure differential is maintained between inlet chamber 23 and load chamber 37. Under these conditions, in a well known manner, flow supplied from the inlet chamber 23 to actuator 13 will be proportional to displacement of valve spool 31 from the position at which load chamber 37 and inlet chamber 23 become connected.

Displacement of valve spool 31 from right to left will at first connect load sensing port 41 through lines 43, 45, check valve 46 and line 48 to load pressure chamber 86. Further movement of valve spool 31 interconnects load chamber 38 with inlet chamber 23 and also interconnects load chamber 37 with outlet chamber 26. The response of the control and the sequence of operations will be the same as those resulting from the displacement of the valve spool 31 in the opposite direction which has already been described in detail.

Assume that valve spools 31 and 55 are simultaneously displaced from left to right, connecting load sensing ports 42 and 65 with load chambers 37 and 61. Assume also that pressure to positive load exists in both load chambers and that load chamber 61 is subjected to higher pressure than load chamber 37. The higher pressure signal from load chamber 61 will be transmitted through load pressure sensing port 65, lines 68 and 69, check valve 70 and line 48 to load pressure chamber 86. The higher load pressure signal from line 48 will also be transmitted by line 47 to check valve 46, in a well known manner maintaining it closed and therefore isolating load sensing port 42 from load pressure chamber 86.

The response of the system control to high pressure signal in load pressure chamber 86 has already been described in detail. However, if resulting pressure in control chamber 73, due to the system load demand will exceed a level equal to the preload in the relief valve sping 104 divided by the cross-sectional area of passage 103, the high pressure pilot relief valve 101 will open and in a well known manner bypass flow from control chamber 73 to reservoir 17. In a manner, as previously described when referring to flow from control chamber 73 through bypass created by differential pressure pilot valve 88, the resistance to flow through orifice 80 will create an unbalance of forces acting on the bypass member 77, moving it from right to left and reducing the system pressure to the level, equivalent to the setting of the high pressure pilot relief valve 101. Under these conditions the high load pressure, existing in load pressure chamber 86, will maintain the differential pressure pilot valve 88 in its fully closed position, the system pressure being maintained at a constant value by high pressure pilot relief valve 101, the characteristics of the flow control valve, of maintaining constant pressure differential between pump and load pressures, being momentarily lost. With drop in load pressure below the setting of the high pressure relief valve, the valve control will assume its normal mode of operation. Since during simultaneous operation of two loads, the control system will maintain a constant pressure differential between the pump pressure and the pressure of the highest of the system loads, the flow control feature of the lower loads will be lost.

With valve spools 31 and 55 in their neutral position no pressure signal will be transmitted to the load pressure chamber 86, and the load pressure chamber 86, through action of the leakage orifice 99, will be subjected to atmospheric pressure. The unloading spool 110, biased by the spring 114, will move to the position as shown in FIG. 1, connecting through passage 112 the control chamber 73 with the system reservoir. Then, in a manner as previously described, the bypass flow control of the pump will automatically revert to its minimum bypass pressure level. Load pressure signal from the system valves will increase pressure in the load pressure chamber 86, which will move the unloading spool 110 to the right, cutting off communication between the control chamber 73 and the system reservoir. Then, in a manner as previously described, through action of differential pressure pilot valve 88, which will reposition the bypass member 77, the pump discharge pressure will be automatically maintained at a level, higher by a constant pressure differential, than the load pressure signal.

Figure 2:
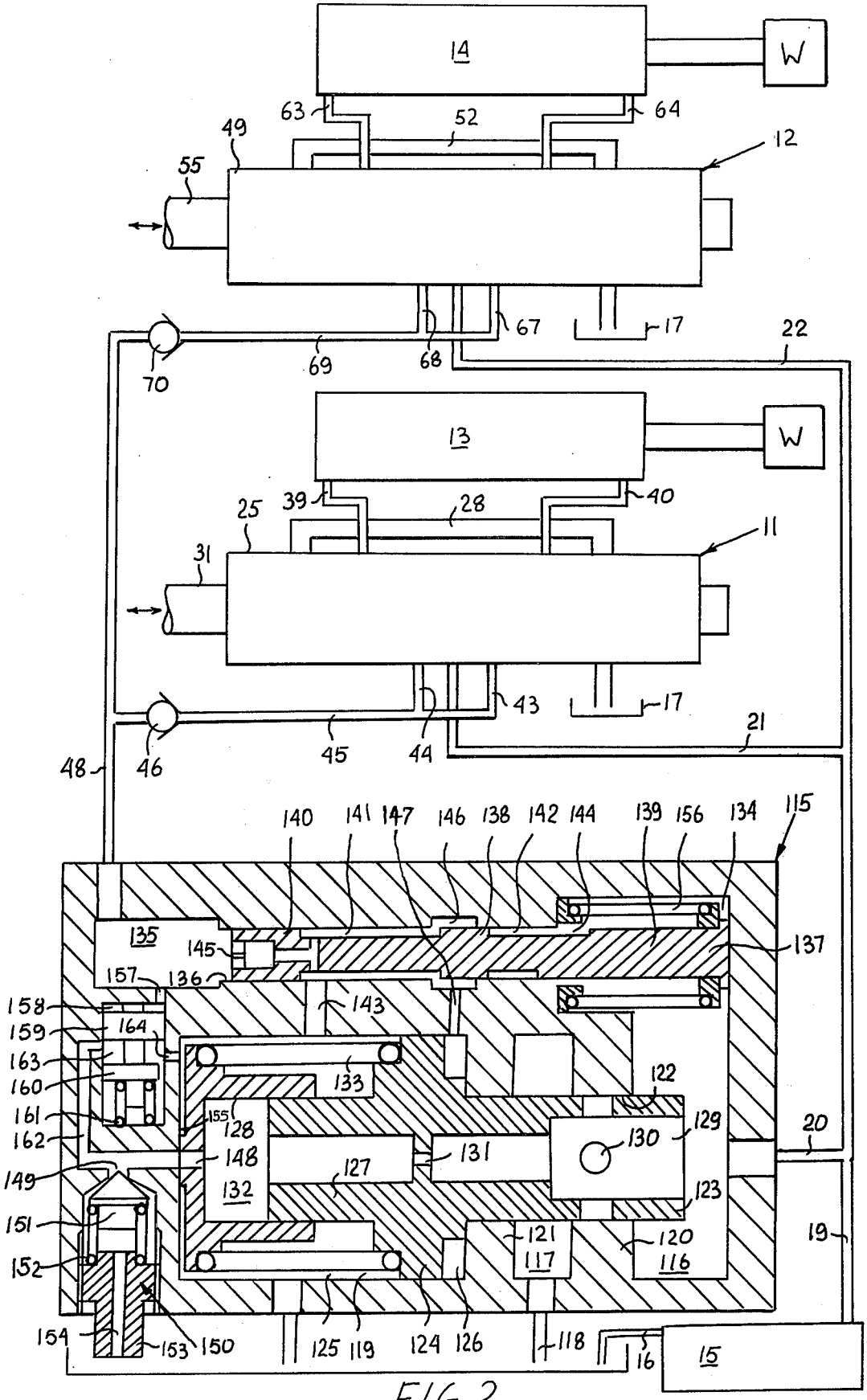
FIG. 2 is a longitudinal sectional view of another embodiment of a two stage pilot operated differential bypass valve equipped with load responsive unloading valve used in control of flow from schematically shown direction control valves with system lines, pump and reservoir shown diagramatically.

Referring now to FIG. 2, an identical arrangement of direction control valve assemblies 11 and 12 are connected to fixed displacement pump 15 and are phased by check valves 46 and 70 to another embodiment of a differential bypass valve assembly, generally designated as 115. The differential bypass valve assembly 115 has a supply chamber 116 communicating with pump 15 through line 20, an exhaust chamber 117 communicating through a line 118 with reservoir 17 and a chamber 119, these chambers being separated by partitions 120 and 121. A bore 122 passing through partitions 120 and 121 interconnects supply chamber 116, exhaust chamber 117 and chamber 119 and axially guides a bypass member 123. Bypass member 123 has a piston 124, dividing chamber 119 into a low pressure zone 125 and a control pressure zone 126. Bypass member 123 has also an extension 127 at one end slidably guiding a reaction cylinder 128 and an inner bore 129 at the other end provided with radially extending circumferentially spaced ports 130 blocked in the position as shown in FIG. 2 by partition 120. Inner bore 129 communicates through a leakage orifice 131 with a space 132 in reaction cylinder 128. A control spring 133 is interposed between reaction cylinder 128 and piston 124, maintaining bypass member 123 in position as shown in FIG. 2.

A portion of space 134 of supply chamber 116, is interconnected with a load pressure chamber 135 by a bore 136, axially guiding a differential pressure pilot valve 137. Differential pressure pilot valve 137 has lands 138, 139 and 140 defining an exhaust space 141 and a high pressure space 142. Exhaust space 141 is connected by a drilling 143 to low pressure zone 125, communicating with reservoir 17 and also communicates through a leakage orifice 145 with load pressure chamber 135. High pressure space 142 communicates through a groove 144 a differential pressure pilot valve 137 with space 134. A control space 146 is connected through a drilling 147 with control pressure zone 126. Space 132 in reaction cylinder 128 is connected through a drilling 148 with a port 149, sealed by a high pressure pilot relief valve, generally designated as 150, which has a poppet 151, a spring 152 and a threaded body 153, equipped with a passage 154. Reaction cylinder 128 is maintained in sealing engagement with a face 155 by preload in control spring 133 and by the pressure in space 132.

The load pressure chamber 135 is connected by passage 157 with annular space 158, which is in direct communication with land 159 of an unloading spool 160, biased towards position as shown in FIG. 2 by a spring 161. Passage 162 connects annular space 163 with space 132. Annular space 163 is also connected by passage 164 with chamber 119, which in turn is connected to the system reservoir 17.

All of the basic system components, as shown in FIG. 2, are at rest in unloaded or unactuated position, with fixed displacement pump 15 not working. When the fixed displacement pump 15 is started up, the pressure in outlet line 19, line 20 and supply chamber 116 will start to rise. Space 132 is connected through passage 162, annular space 163, passage 164 and chamber 119 with system reservoir 17. Therefore the bypass member 123 is subjected to a pressure differential, equal to the pressure generated by fixed displacement pump 15 in the supply chamber 116. This pressure, reacting on the cross-sectional area of the bypass member 123, will move it against the biasing force of control spring 133 from right to left, connecting with ports 130 the supply chamber 116 with the exhaust chamber 117. The equilibrium condition will be reached, at which full discharge flow of the pump will be bypassed by the bypass member 123 to the system reservoir 17 at a minimum pressure level, corresponding to the preload in the control spring 133, which is so selected that the full bypass flow is obtained at relatively low pressure, resulting in minimum system standby horsepower loss.

Assume that the pressure in the load pressure chamber 135 will be gradually increased, moving the unloading spool 160 downwards against biasing force of spring 161. The unloading spool 160 will block communication between space 132 and the system reservoir. Fluid flow, transmitted through leakage orifice 131, will increase pressure in space 132 and the bypass member 123 will be moved by the control spring 133 from left to right, increasing the resistance to bypass flow between the supply chamber 116 and the exhaust chamber 117. The rising fluid pressure in supply chamber 116 supplied to space 134 will react on the cross-sectional area of differential pressure pilot valve 137, generating a force, which would tend to move it from right to left against biasing force of a differential spring 156. The load pressure chamber 135 is subjected to a low pressure and connected to system reservoir 17 through leakage orifice orifice 145, exhaust space 141, drilling 143 and low pressure zone 125. As soon as pressure in supply chamber 116 and space 134 generates a sufficiently high force on cross-sectional area of differential pressure pilot valve 137 to overcome the preload of differential spring 156 and pressure in the load pressure chamber 135, the differential pilot valve 137 will move from right to left, trying to displace fluid from load pressure chamber 135. The resulting rise in pressure in load pressure chamber 135 will first close check valves 46 and 70, isolating load pressure chamber 135 from directional control valve assemblies 11 and 12. Rising pressure in load pressure chamber 135 will induce, in a well known manner, fluid flow through leakage orifice 145, permitting movement of differential pressure pilot valve 137 from right to left, the speed of movement being proportional to rate of leakage through leakage orifice 145 and therefore being a function of pressure in load pressure chamber 135 and cross-sectional area of differential pressure pilot valve 137. The movement of differential pressure pilot valve 137 through displacement of land 138 will first close communication between control space 146 and exhaust space 141 and then open control space 146 to high pressure space 142. The rising pressure in control space 146 will be transmitted through drilling 147 to control pressure zone 126 and will react on the effective cross-sectional area of piston 124, compressing control spring 133 and moving the bypass member 123 from right to left. The differential pressure pilot valve 137 will modulate, maintaining bypass member 123 in a bypass position, which in turn will maintain the pressure in supply chamber 116 at a level, equal to the preload of the differential spring 156 divided by the cross-sectional area of differential pressure pilot valve 137. An increase in pressure in load pressure chamber 135 will move the differential pressure pilot valve 137 from left to right, connecting control space 146 with exhaust space 141. With a drop in pressure in control pressure zone 126 under the action of the control spring 133, the bypass member 123 will move from left to right, decreasing the amount of bypass flow. As a result the pressure in the supply chamber 108 will start to rise, until it will overcome the combined force of the differential spring 156 and force generated by the pressure in load pressure chamber 135, acting on cross-sectional area of differential pressure pilot valve 137, moving it back to its modulating position. Therefore differential pressure pilot valve 137 will always control the position of the bypass member 123 to maintain a constant pressure differential between supply chamber 116 and load pressure chamber 135, this pressure differential being equal to the preload of the differential spring 156 divided by the cross-sectional area of the differential pressure pilot valve 137. If the pressure in supply chamber 116 and space 132 rises to a level, at which it overcomes the preload of spring 152 of the high pressure pilot relief valve 150 a flow of fluid is induced from the space 132 to reservoir 17. This flow of fluid from space 132 is supplied through leakage orifice 131 from supply chamber 116 and creates a pressure drop through leakage orifice 131 which in turn, in a well known manner, unbalances the forces acting on bypass member 123, moving it from right to left to a position where sufficient fluid from the supply chamber 116 is bypassed to exhaust chamber 117 to maintain the discharge pressure of pump 15 at the pressure setting of the high pressure relief valve 150. While the system pressure is maintained by the high pressure pilot relief valve 150, the differential pressure pilot valve 137 is maintained by high pressure in load pressure chamber 135 in the position as shown in FIG. 2, with control space 146 connected to exhaust space 141. With the drop in pressure in the load pressure chamber 135, high pressure pilot relief valve 150 closes and the differential pressure pilot valve 137 reverts to its modulating position, maintaining, as previously described, a constant pressure differential between supply chamber 116 and load pressure chamber 135.

With valve spools 31 and 55 in their neutral position no load pressure will be supplied from direction control valve assemblies 11 and 12 and therefore through action of leakage orifice 145 the load pressure chamber 135 will be maintained at atmospheric pressure. Spring 161 will maintain the unloading spool 160 in position as shown in FIG. 2, in a manner as previously described the pump flow being bypassed at minimum pressure level to the system reservoir 17.

Actuation of direction control valve assemblies 11 and 12, in a manner as previously described when referring to FIG. 1, will transmit through check valves 46 and 70 the highest positive load system pressure to the load pressure chamber 135. Increasing pressure in the load pressure chamber 135 will move the unloading valve 160 downward while reacting on cross-sectional area of the pilot valve 137. The differential bypass valve assembly 115 will respond, in a manner as already described above, always maintaining a constant pressure differential between supply chamber 116 and load pressure chamber 135.

The basic operation of the differential bypass valve assembly 10 of FIG. 1 and 115 of FIG. 2 is the same, since both of them maintain a constant pressure differential between their respective supply chambers and load pressure chambers. Furthermore both of those valves maintain this constant pressure differential by regulating, through change in position of a bypass member, the amount of fluid bypassed from supply chamber to system reservoir. Both of those valves provide high response with only minimal leakage from load pressure chambers and both of those valves use energy of the pump in moving bypass members. Those valves differ only in the way the respective differential pressure pilot valves control the position of the bypass members. In differential bypass valve assembly 10 the differential pressure pilot valve 88 regulates the control flow from control chamber 73 and by subjecting bypass member 77 to unbalanced force condition, regulates its position. In differential bypass valve assembly 115 differential pressure pilot valve 137 regulates the pressure in control pressure zone 126, therefore controlling the position of the bypass member 123 and the quantity of bypass flow of fluid between supply chamber 116 and system reservoir.

Through the use of two stage differential bypass valve assemblies 10 and 107 and specifically through the use of differential pressure pilot valves 88 and 137 very fast response of the control can be obtained, both while increasing and decreasing the bypass flow of the control, in response to the load pressure signal. While increasing the bypass flow, because of its extremely small control stroke and small cross-sectional area, the response of the differential pressure pilot valve, even with minimum leakage through leakage orifices 99 and 145 is very fast. On the other hand, when decreasing the bypass flow, the flows through the load sensing circuits, resulting from the displacement of the differential pressure pilot valve through its control stroke are so small that the attenuation of the load pressure signal in the control lines is minimal. At the same time the response of the bypass members 77 and 123 to the control signal of the differential pressure pilot valves 88 and 137 is very fast, since energy derived from pump circuit is utilized to displace comparatively large bypass members 77 and 123.

The use of unloading spools 110 and 160 of FIGS. 1 and 2 responsive to load pressure signals permits lowering of the pump bypass pressure to a minimum level, while system loads are not being operated. Operation of any of the system valves controlling a positive load actuates the unloading spool, the minimum system bypass pressure then being dictated by the characteristics of differential springs 100 and 156. Therefore the use of load responsive unloading spools 110 and 160 permits a minimum bypass pressure and therefore a minimum system bypass loss, when the system valves are not controlling the system loads, while permitting a choice of relatively high pressure differential between the pump pressure and the load pressure, when the system loads are being controlled.

Although preferred embodiments of this invention have been shown and described in detail it is recognized that the invention is not limited to the precise forms and structure shown and various modifications and rearrangements as will readily occur to those skilled in the art upon full comprehension of this invention may be resorted to without departing from the scope of the invention as defined in the claims.

What is claimed is:

1. A valve assembly comprising at least one housing having an inlet chamber, a load chamber, and exhaust means communicable with reservoir means, first valve means for selectively interconnecting said load chamber with said inlet chamber and said exhaust means, load sensing port means selectively communicable with said load chamber by said first valve means, bypass valve means between said inlet chamber and said exhaust means having actuating means, pilot valve means having signal generating means responsive to pressure differential between pressure in said inlet chamber and pressure in said load sensing port means, said signal generating means of said pilot valve means operable through said actuating means of said bypass valve means to vary bypass flow between said inlet chamber and said exhaust means to maintain a constant pressure differential between said inlet chamber and said load sensing port means when pressure in said load sensing port means is above a certain predetermined level, and unloading valve means having means responsive to pressure in said pressure sensing port means, said unloading valve means operable through said actuating means of said bypass valve means to lower pressure in said inlet chamber when pressure in said load sensing port means is below said certain predetermined level.

2. A valve assembly as set forth in claim 1 wherein leakage means interconnects for fluid flow said load sensing port means and said exhaust means.

3. A valve assembly as set forth in claim 1 wherein said actuating means has means responsive to pressure drop due to fluid flow across an orifice means and said signal generating means of said pilot valve means has means controlling fluid flow through said orifice means.

4. A valve assembly as set forth in claim 1 wherein said actuating means has pressure responsive force generating means and said signal generating means of said pilot valve means has means to control pressure delivered to said pressure responsive force generating means.

5. A valve assembly as set forth in claim 1 wherein said signal generating means of said pilot valve means includes first force generating means responsive to pressure in said inlet chamber, second force generating means responsive to pressure in said load sensing port means and spring biasing means opposing force developed by said first force generating means.

6. A valve assembly as set forth in claim 1 wherein said unloading valve means has means responsive to pressure differential betweeen pressure in said load sensing port means and pressure in said reservoir means.

7. A valve assembly comprising a multiplicity of housings each housing having an inlet chamber, a load chamber, and exhaust means communicable with reservoir means, first valve means in each housing for selectively interconnecting said load chamber with said inlet chamber and said exhaust means, load sensing port means in each housing selectively communicable with said load chamber by said first valve means, check valve means operably connected with each of said load sensing port means to permit flow from said load sensing port means to a control pressure zone and to block reverse flow from said control pressure zone, bypass valve means between said inlet chambers and said exhaust means having an actuating means, pilot valve means having signal generating means responsive to pressure differential between pressure in said inlet chamber and pressure in said load sensing means, said signal generating means of said pilot valve means operable through said actuating means of said bypass valve means to vary bypass flow between said inlet chambers and said exhaust means to maintain a relatively constant pressure differential between said inlet chambers and said control pressure zone when pressure in said control pressure zone is above a certain predetermined level, and unloading valve means having means responsive to pressure in said control pressure zone, said unloading valve means operable through said actuating means of said bypass valve means to lower pressure in said inlet chambers when pressure in said control pressure zone is below said certain predetermined level.

8. A valve assembly as set forth in claim 7 wherein leakage means interconnects for fluid flow said control pressure zone and said exhaust means.

9. A valve assembly as set forth in claim 7 wherein said actuating means has means responsive to pressure drop due to fluid flow across an orifice means and said signal generating means of said pilot valve means has means controlling fluid flow through said orifice means.

10. A valve assembly as set forth in claim 7 wherein said actuating means has pressure responsive force generating means and said signal generating means of said pilot valve means has means to control pressure delivered to said pressure responsive force generating means.

11. A valve assembly as set forth in claim 7 wherein said signal generating means of said pilot valve means includes first force generating means responsive to pressure in said inlet chambers, second force generating means responsive to pressure in said control pressure zone and spring biasing means opposing force developed by said first force generating means.

12. A valve assembly as set forth in claim 7 wherein said unloading valve means has means responsive to pressure differential between pressure in said control pressure zone and pressure in said reservoir means.

13. A valve assembly comprising at least one housing having an inlet chamber, a load chamber, and exhaust means communicable with reservoir means, first valve means for selectively interconnecting said load chamber with said inlet chamber and said exhaust means, load sensing port means selectively communicable with said load chamber by said first valve means, bypass valve means between said inlet chamber and said exhaust means having actuating means including force means responsive to pressure drop through orifice means, pilot valve means having signal generating means responsive to pressure differential between pressure in said inlet chamber and pressure in said load sensing port means, said signal generating means including means to regulate fluid flow through said orifice means, said signal generating means of said pilot valve means operable through said force means of said actuating means to vary bypass flow between said inlet chamber and said exhaust means to maintain a relatively constant pressure differential between said inlet chamber and said load sensing port means when pressure in said load sensing port means is above a certain predetermined level, and unloading valve means having means responsive to pressure in said pressure sensing port means, said unloading valve means having means operable through said force means of said actuating means of said bypass valve means to lower pressure in said inlet chamber when pressure in said load sensing port means is below said certain predetermined level.

14. A valve assembly comprising at least one housing having an inlet chamber, a load chamber, and exhaust means communicable with reservoir means, first valve means for selectively interconnecting said load chamber with said inlet chamber and said exhaust means, load sensing port means selectively communicable with said load chamber by said first valve means, bypass valve means between said inlet chamber and said exhaust means having actuating means and orifice means, pilot valve means having signal generating means responsive to pressure differential between pressure in said inlet chamber and pressure in said load sensing port means, said signal generating means including pressure modulating means to supply modulated pressure signal to said actuating means of said bypass valve means to vary bypass flow between said inlet chamber and said exhaust means to maintain a relatively constant pressure differential between said inlet chamber and said load sensing port means when pressure in said load sensing port means is above a certain predetermined level, and unloading valve means having means responsive to pressure in said pressure sensing port means, said unloading valve means having means operable through said orifice means of said bypass valve means to lower pressure in said inlet chamber when pressure in said load sensing port means is below said certain predetermined level.

15. A valve assembly comprising at least one housing having an inlet chamber, a load chamber, and exhaust means communicable with reservoir means, first valve means for selectively interconnecting said load chamber with said inlet chamber and said exhaust means, load sensing port means selectively communicable with said load chamber by said first valve means, bypass valve means between said inlet chamber and said exhaust means having actuating means, force means responsive to pressure drop through orifice means in said actuating means, pilot valve means having signal generating means responsive to pressure differential between pressure in said inlet chamber and pressure in said load sensing port means, said signal generating means including first force generating means responsive to pressure in said inlet chamber, second force generating means responsive to pressure in said load sensing port means, spring biasing means opposing force developed by said first force generating means and means to regulate fluid flow through said orifice means, said signal generating means to said pilot valve means operable through said force means of said actuating means to vary bypass flow between said inlet chamber and said exhaust means to maintain a relatively constant pressure differential between said inlet chamber and said load sensing port means when pressure in said load sensing port means is above a certain predetermined level, and unloading valve means including means communicable with said reservoir means, third force generating means responsive to pressure in said pressure sensing port means, spring biasing means opposing force developed by said third force generating means, and means to communicate down stream of said orifice means with said reservoir means when pressure in said load sensing port means is below a certain predetermined level.

16. A valve assembly as set forth in claim 15 wherein maximum pressure relief valve means has means operable through said orifice means to bypass flow by said bypass valve means from said inlet chamber to said exhaust means to maintain pressure in said inlet chamber at a preselectable maximum pressure level.

17. A valve assembly comprising at least one housing having an inlet chamber, a load chamber, and exhaust means communicable with reservoir means, first valve means for selectively interconnecting said load chamber with said inlet chamber and said exhaust means, load sensing port means selectively communicable with said load chamber by said first valve means, bypass valve means between said inlet chamber and said exhaust means having actuating means responsive to a control pressure signal and orifice means, pilot valve means having signal generating means responsive to pressure differential between pressure in said inlet chamber and pressure in said load sensing port means, said signal generating means including first force generating means responsive to pressure in said inlet chamber, second force generating means responsive to pressure in said load sensing port means, spring biasing means opposing force developed by said first force generating means and control pressure signal modulating means operable through said actuating means of said bypass valve means to vary bypass flow between said inlet chamber and said exhaust means to maintain a relatively constant pressure differential between said inlet chamber and said load sensing port means when pressure in said load sensing port means is above a certain predetermined level and unloading valve means including means communicable with said reservoir means, third force generating means responsive to pressure in said pressure sensing port means, spring biasing means opposing force developed by said third force generating means, and means to communicate down stream of said orifice means with said reservoir means when pressure in said load sensing port means is below a certain predetermined level.

18. A valve assembly as set forth in claim 17 wherein maximum pressure relief valve means has means operable through said orifice means to bypass flow by said bypass means from said inlet chamber to said exhaust means to maintain pressure in said inlet chamber at a preselectable maximum pressure level.

19. A valve assembly comprising a multiplicity of housings each housing having an inlet chamber, a load chamber, and exhaust means communicable with reservoir means, first valve means in each housing for selectively interconnecting said load chamber with said inlet chamber and said exhaust means, load sensing port means in each housing selectively communicable with said load chamber by said first valve means, check valve means operably connected with each of said load sensing port means to permit flow from said load sensing port means to a control pressure zone and to block reverse flow from said control pressure zone, bypass valve means between said inlet chambers and said exhaust means having actuating means, force means responsive to pressure drop through orifice means in said actuating means, pilot valve means having signal generating means responsive to pressure differential between pressure in said inlet chambers and pressure in said control pressure zone, said signal generating means including first force generating means responsive to pressure in said inlet chambers, second force generating means responsive to pressure in said control pressure zone, spring biasing means opposing force developed by said first force generating means and means to regulate fluid flow through said orifice means, said signal generating means of said pilot valve means operable through said force means of said actuating means to vary bypass flow between said inlet chambers and said exhaust means to maintain a relatively constant pressure differential between said inlet chambers and said control pressure zone when pressure in said control pressure zone is above a certain predetermined level, and unloading valve means including means communicable with said reservoir means, third force generating means responsive to pressure in said control pressure zone, spring biasing means opposing force developed by said third force generating means, and means to communicate down stream of of said orifice means with said reservoir means when pressure in said control pressure zone is below a certain predetermined level.

20. A valve assembly comprising a multiplicity of housings each housing having an inlet chamber, a load chamber, and exhaust means communicable with reservoir means, first valve means in each housing for selectively interconnecting said load chamber with said inlet chamber and said exhaust means, load sensing port means in each housing selectively communicable with said load chamber by said first valve means, check valve means operably connected with each of said load sensing port means to permit flow from said load sensing port means to a control pressure zone and to block reverse flow from said control pressure zone, bypass valve means between said inlet chambers and said exhaust means having actuating means responsive to a control pressure signal and orifice means, pilot valve means having signal generating means responsive to pressure differential between pressure in said inlet chambers and pressure in said control pressure zone, said signal generating means including first force generating means responsive to pressure in said inlet chambers, second force generating means responsive to pressure in said control pressure zone, spring biasing means opposing force developed by said first force generating means and control pressure signal, modulating means operable through said actuating means of said bypass valve means to vary bypass flow between said inlet chambers and said exhaust means to maintain a relatively constant pressure differential between said inlet chamber and said control pressure zone when pressure in said control pressure zone is above a certain predetermined level and unloading valve means including means communicable with said reservoir means, third force generating means responsive to pressure in said control pressure zone, spring biasing means opposing force developed by said third force generating means, and means to communicate down stream of said orifice means with said reservoir means when pressure in said control pressure zone is below a certain predetermined level.

* * * * *